US005389322A

United States Patent [19]

Kim et al.

[11] Patent Number: 5,389,322

[45] Date of Patent: Feb. 14, 1995

[54] METHOD FOR MANUFACTURE OF BIODEGRADABLE DISPOSABLE CONTAINER

[76] Inventors: Doo-hyun Kim, 404-908 Jugong Apartment, 751-1, Sang Gaedong, Nowon-ku, Seoul; Jae-il Kim, 202-206 Jugong Apartment, 208,210,212 Shanbon-dong, Gunpo-shi, Kyongki-do, both of Rep. of Korea

[21] Appl. No.: 124,305

[22] Filed: Sep. 20, 1993

[30] Foreign Application Priority Data

Dec. 31, 1992 [KR] Rep. of Korea ..... 1992-27293

[51] Int. Cl.[6] ..... B27N 5/02; B27N 1/02

[52] U.S. Cl. ..... 264/112; 264/37; 264/109; 426/138; 428/35.6

[58] Field of Search ..... 264/37, 53, 109, 112; 426/138; 428/35.6

[56] References Cited

U.S. PATENT DOCUMENTS

| | | | |
|---|---|---|---|
| 4,244,903 | 1/1981 | Schnaase | 264/68 |
| 4,376,089 | 6/1981 | Bogner et al. . | |
| 4,376,745 | 6/1981 | Johns . | |
| 4,386,190 | 8/1981 | Bailey . | |
| 4,393,169 | 11/1981 | Moriwaki et al. . | |
| 4,405,542 | 1/1982 | Greer . | |
| 4,525,367 | 6/1985 | Allison | 426/394 |
| 4,751,034 | 6/1988 | Delong et al. | 264/115 |
| 4,889,669 | 12/1989 | Suzuki | 264/45.9 |
| 5,206,087 | 4/1993 | Tokiwa et al. | 428/403 |
| 5,288,318 | 2/1994 | Mayer et al. | 106/213 |
| 5,317,119 | 5/1994 | Ayres | 219/734 |
| 5,320,669 | 6/1994 | Lim et al. | 106/157 |

*Primary Examiner*—Robert A. Dawson
*Assistant Examiner*—Dennis J. Chismar
*Attorney, Agent, or Firm*—Vidas, Arrett & Steinkraus

[57] ABSTRACT

A method for manufacture of a biodegradable disposable container, which container is biodegradable and reduces generation amount of the refuse, and prevents environmental pollution. The method comprises the steps of i) mixing 40–46 weight % of fine granular sawdust powder with 29–35 weight % of albumen and agitating, ii) mixing the result mixture with 17–23% of a potato starch and 4–6% of sodium metaphosphate and agitating, iii) compression-molding the result mixture into a container by a compression mold under the pressure of about 3 Kg/cm$^2$, iv) steaming the compression-molded container in a steaming box for about 30 minutes at a temperature in the range of about 85° C.–95° C. and drying, and v) applying a resin coating to inner and outer surfaces of the container and drying.

7 Claims, No Drawings

METHOD FOR MANUFACTURE OF BIODEGRADABLE DISPOSABLE CONTAINER

BACKGROUND OF THE INVENTION

1. Field of the Invention

The present invention is generally to a disposable container, and more particularly to a method for manufacture of a disposable container for food.

2. Description of the Prior Art

In recent, disposable containers are wide used to contain foods, such as vegetables, flesh and meat, boiled fish paste and fruit to be merchandised under refrigeration. Furthermore, cupped instant noodles, recently spent in large quantities, are attended with large consumption of such a disposable container. The disposable containers are conventionally made of a styrene foam.

However, such a conventional disposable container made of the styrene foam, while being easy to manufacture and handle, nevertheless has a problem in that it has a larger specific volume and results in generation of large quantity of refuse. Furthermore, as well known to those skilled in the art, the styrene foam is not biodegradable semi-permanently and generates a toxic gas when incinerated, so that the use of disposable container made of the styrene foam causes environmental pollution.

SUMMARY OF THE INVENTION

It is, therefore, an object of the present invention to provide a method for manufacture of a biodegradable disposable container, which container is thrown away while being broken and easily biodegradable, thereby reducing generation amount of the refuse and preventing environmental pollution caused by the disposable container.

To accomplish the above object, a method for manufacture of a biodegradable container according to the present invention comprises the steps of (i) mixing 40–46 weight % of fine granular sawdust powder with 29–35 weight % of albumen, a liquid protein, and agitating; (ii) mixing the result mixture of the step (i) with 17–23% of a potato starch and 4–6% of sodium metaphosphate and agitating; (iii) compression-molding the result mixture of the step (ii) into a container by a compression mold under the pressure of about 3 $Kg/cm^2$; (iv) steaming the container of the step (iii) in a steaming box for about 30 minutes at a temperature in the range of about 85° C.–95° C., and drying; and (v) applying a resin coating, preferably urethane coating, to inner and outer surfaces of the result container of the step (iv), and drying.

DETAILED DESCRIPTION OF THE PREFERRED EMBODIMENTS

The biodegradable disposable container of the present invention is manufactured as follows.

40–46 weight % of sawdust powder, prepared by fine grinding of sawdust, 29–35 weight % of albumen, or a liquid protein, are blended uniformly with each other and stirred up sufficiently. The result mixture is mixed with 17–23% of potato starch as well as 4–6% of sodium metaphosphate and stirred up. The result mixture is compression-molded into a container by employing a compression mold under the pressure of 3 $Kg/cm^2$. The molded container is, thereafter, steamed in a steaming box for 30 minutes at 85° C.–95° C. and dried. The result container is in turn applied, on its inner and outer surfaces, with an urethane coating. The coating step is followed by a drying step. In this case, it is preferred to make the urethane coating have a thickness in the range of about 25–35 $\mu m$.

In this case, the sawdust powder may be substituted with rice hull powder or rice straw powder and the starch may be selected from starches other than the potato starch. In addition, the urethane coating may be substituted with epoxy coating which is added with a hardener in a ratio of 1:1.

In the aforementioned process, the sawdust powder is covered with the liquid protein of the albumen as a result of the first agitation where the mixture of the sawdust powder with the albumin are stirred-up. The second agitation, where the mixture resulting from the first agitation is mixed with the potato starch and the sodium metaphosphate, gives the mixture a good bonding power, which is a specific characteristic of the starch, as well as a good bonding cohesive force caused by the sodium metaphosphate, thereby giving the result mixture an excellent moldability. All of the above components of the container composition are harmless to the human body and biodegradable.

As a result of pH test using a litmus paper, the result container of the present invention shows pH 6–7, meaning neutrality. Such a neutrality of the container means that the container is suitable for used as a food container. In addition, the container of the present invention scarcely generates toxic gas when it is incinerated, thereby causing no environmental pollution.

The urethane coating step is performed to give the container waterproof, which is regarded as an important performance especially when the container is to be used as a water container, such as a container for the cupped instant noodle. In this regard, when the result container is to be used as a container having no relation with water, the urethane coating step may be omitted from the above manufacturing process with no influence to the strength and the antipollution characteristic of the result container.

As described above, the present invention provides a pollution-free disposable container suitable for used as a container for refrigerated food, such as fish, vegetables, flesh and meat, boiled fish paste or fruit to be merchandised under refrigeration, as well as a container for a cooked food, such as wheat noodles or soup noodles. The container of the present invention, made of the biodegradable sawdust powder, takes part in recent trend of conservation of resources and antipollution.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method for manufacture of a biodegradable disposable container comprising the steps of:

(i) mixing 40–46 weight % of fine granular sawdust powder with 29–35 weight % of a liquid protein, and agitating;

(ii) mixing the resultant mixture of step (i) with 17–23% of a starch and 4–6% of sodium metaphosphate and agitating;

(iii) compression-molding the resultant mixture of step (ii) into a container under a pressure of about 3 $Kg/cm^2$;

(iv) steaming the container of step (iii) in a steaming box for about 30 minutes at a temperature in the range of about 85° C.–95° C., and drying; and (v) applying a resin coating to inner and outer surfaces of the resultant container of step (iv) and drying.

2. A method according to claim 1, wherein said liquid protein is albumen.

3. A method according to claim 1, wherein said starch is a potato starch.

4. A method according to claim 1, wherein said resin coating is a urethane coating.

5. A method according to claim 1, wherein said resin coating is an epoxy coating, added with a hardener in a ratio of 1:1.

6. A method for manufacture of a biodegradable disposable container comprising the steps of:

(i) mixing 40–46 weight % of rice hull powder with 29–35 weight % of a liquid protein, and agitating;

(ii) mixing the resultant mixture of step (i) with 17–23% of a starch and 4–6% of sodium metaphosphate and agitating;

(iii) compression-molding the resultant mixture of step (ii) into a container under a pressure of about 3 $Kg/cm^2$;

(iv) steaming the container of step (iii) in a steaming box for about 30 minutes at a temperature in the range of about 85° C.–95° C., and drying; and (v) applying a resin coating to inner and outer surfaces of the resultant container of step (iv) and drying.

7. A method for manufacture of a biodegradable disposable container comprising the steps of:

(i) mixing 40–46 weight % of rice straw powder with 29–35 weight % of a liquid protein, and agitating;

(ii) mixing the resultant mixture of step (i) with 17–23% of a starch and 4–6% of sodium metaphosphate and agitating;

(iii) compression-molding the resultant mixture of step (ii) into a container under a pressure of about 3 $Kg/cm^2$;

(iv) steaming the container of step (iii) in a steaming box for about 30 minutes at a temperature in the range of about 85° C.–95° C., and drying; and (v) applying a resin coating to inner and outer surfaces of the resultant container of step (iv) and drying.

* * * * *